US010557091B2

(12) United States Patent
Lok et al.

(10) Patent No.: US 10,557,091 B2
(45) Date of Patent: Feb. 11, 2020

(54) PROCESS FOR INCREASING HYDROCARBON YIELD FROM CATALYTIC REFORMER

(71) Applicant: UOP LLC, Des Plaines, IL (US)

(72) Inventors: Ka L. Lok, Buffalo Grove, IL (US); Bryan K. Glover, Algonquin, IL (US); Alexander V. Sabitov, Wilmette, IL (US); Jeffrey R. Grott, Chicago, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 15/601,871

(22) Filed: May 22, 2017

(65) Prior Publication Data

US 2018/0029956 A1 Feb. 1, 2018

Related U.S. Application Data

(60) Provisional application No. 62/368,064, filed on Jul. 28, 2016.

(51) Int. Cl.

| | |
|---|---|
| ***C10G 63/02*** | (2006.01) |
| ***C10G 59/04*** | (2006.01) |
| ***C10G 61/02*** | (2006.01) |
| ***C10G 35/10*** | (2006.01) |

(52) U.S. Cl.

CPC ..... *C10G 63/02* (2013.01); *C10G 35/10* (2013.01); *C10G 59/04* (2013.01); *C10G 61/02* (2013.01); *C10G 2300/1037* (2013.01); *C10G 2300/4012* (2013.01); *C10G 2300/4018* (2013.01); *C10G 2300/70* (2013.01); *C10G 2400/02* (2013.01); *C10G 2400/26* (2013.01); *C10G 2400/30* (2013.01)

(58) Field of Classification Search

CPC ..... B01J 8/12; B01J 8/125

See application file for complete search history.

(56) References Cited

U.S. PATENT DOCUMENTS 2,766,186 A * 10/1956 Nadro, Jr. ..... B01J 8/085 208/166

3,223,616 A 12/1965 Huntington (Continued)

FOREIGN PATENT DOCUMENTS

| | | |
|---|---|---|
| CN | 103073377 A | 5/2013 |
| JP | 11108561 A | 4/1999 |
| RU | 2180346 C2 | 3/2002 |

OTHER PUBLICATIONS

PCT Search Report dated Sep. 14, 2017 for International Application No. PCT/US2017/041722.

*Primary Examiner* — Philip Y Louie
*Assistant Examiner* — Alyssa L Cepluch

(57) ABSTRACT

A reforming reactor and process of using same in which residence time of feed within a chamber of a reactor is shortened. Feed is injected into the reactor into a non-reactive zone. The non-reactive zone has two portions, a first portion receiving the feed, and a second portion receiving a purge gas. The purge gas will flow from the second portion to the first portion to prevent flow of the feed from the first portion to the second portion. The combined gas may be passed to a reaction zone for catalytic reforming. The first portion and the second portion may be separated by a baffle.

10 Claims, 4 Drawing Sheets

(56) References Cited

U.S. PATENT DOCUMENTS

| | | | | | |
|---|---|---|---|---|---|
| 3,706,536 | A | * | 12/1972 | Greenwood | B01J 8/125 208/140 |
| 4,167,473 | A | * | 9/1979 | Sikonia | C10G 35/12 208/139 |
| 4,567,023 | A | | 1/1986 | Greenwood et al. | |
| 5,366,704 | A | | 11/1994 | Koves et al. | |
| 5,580,241 | A | | 12/1996 | Koeberle et al. | |
| 5,683,573 | A | | 11/1997 | Haizmann et al. | |
| 6,224,838 | B1 | | 5/2001 | Schulz et al. | |
| 6,657,096 | B2 | | 12/2003 | Boehner et al. | |
| 7,531,142 | B2 | | 5/2009 | Huziwara et al. | |
| 7,842,257 | B2 | | 11/2010 | Fecteau | |
| 8,691,155 | B2 | | 4/2014 | Palmas et al. | |
| 8,894,940 | B2 | | 11/2014 | Krishnamurthy et al. | |
| 2010/0160148 | A1 | | 6/2010 | Nabozny | |
| 2014/0205506 | A1 | | 7/2014 | Whittenberger et al. | |
| 2014/0294682 | A1 | | 10/2014 | Vetter et al. | |
| 2015/0057480 | A1 | | 2/2015 | Jeffrey et al. | |

* cited by examiner

PROCESS FOR INCREASING HYDROCARBON YIELD FROM CATALYTIC REFORMER

CROSS-REFERENCE TO RELATED APPLICATION

This application claims priority from Provisional Application No. 62/368,064 filed Jul. 28, 2016, the contents of which cited application are hereby incorporated by reference in its entirety.

FIELD OF THE INVENTION

This invention relates generally to an apparatus and process for catalytic reforming of hydrocarbons and more particularly to an apparatus and process for increasing the yield from such an apparatus.

BACKGROUND OF THE INVENTION

The reforming of petroleum raw materials is an important process for producing useful products. For example, reforming can be used in processes for the separation and upgrading of hydrocarbons for use as a transportation fuel, such as producing a naphtha feedstream and upgrading the octane value of the naphtha in the production of gasoline. Additionally, hydrocarbons in feedstreams from a raw petroleum source may also be utilized the production of desired chemical precursors for use in the production of plastics, detergents and other products. Accordingly, reforming may be used to produce the desired chemical precursors.

The catalytic reforming process is well known in the art. The principal reactions that take place are the dehydrogenation of naphthenes to aromatics, dehydrocyclization of paraffins, isomerization of paraffins and naphthenes, hydrocracking of paraffins to light hydrocarbons, and formation of coke which is deposited on the catalyst. The formation of coke on the catalyst causes the catalyst to gradually lose activity over time. Accordingly, the catalyst requires regeneration and/or replacement. A continuous transfer of catalyst from and to the reactor is highly desirable.

Typically, in such a reactor, a hydrocarbon feedstock and a hydrogen-rich gas are preheated and charged to a reforming zone containing typically two to five reactors in series. The effluent from the first reactor is withdrawn, heated, and passed to the second reactor. The effluent from the second reactor is withdrawn, reheated and passed to the third reactor. The withdrawal and reheating of the effluent continues until the last reactor and is typically referred to as a radial flow. From the last reactor, the effluent is withdrawn and processed further.

The feedstock/partially converted effluent streams are oftentimes passed into the reactor stack via non-reactive sections that are thermally unstable. Catalyst flows downward through the non-reactive sections in conduits so as to avoid contacting the feedstock/partially converted effluent streams. This empty same is required for meeting the hydraulics requirements in some reactors. In other reactors, the space is required for the reactor inspection, maintenance, and repair.

However, within the non-reactive zones preceding, or upstream, of each reactive zones, the compounds in the feed for that reactive zone may undergo undesired non-catalyzed molecular weight reduction transformation. These molecular weight reduction transformation reactions occur in the absence of catalyst and produce less desirable chemicals and lower the production yield of the reactor.

Therefore, it would be desirable to minimize the molecular weight reduction, while maintaining the required space necessary for hydraulics or maintenance.

SUMMARY OF THE INVENTION

A reactor and a process of reforming using same have been invented which maintains the required space necessary for hydraulics or maintenance, but lowers the molecular weight reduction by minimizing or lowering the amount of the space that is accessible to the feedstock/partially converted effluent streams. It has been discovered that by minimizing this space, or at least the amount of space accessible to the feedstock/partially converted effluent streams, a non-catalyzed molecular weight reduction transformation in a manner that the molecules breaks down to two or more smaller molecules with lower molecular weight in absence of catalyst environment can be minimized.

Therefore in a first aspect of the invention, the present invention may be broadly characterized as providing a process for increasing a $C_5$+ hydrocarbon yield in a reforming reactor unit by: passing a catalyst though a first non-reactive zone of a reactor to a first reaction zone of the reactor, the non-reactive zone comprising a first portion and a second portion, the first portion and the second portion separated by a baffle; injecting a hydrocarbon feed stream into the first portion of the first non-reactive zone of the reactor; injecting a purge gas stream into the second portion of the first non-reactive zone; passing the purge gas to the reaction zone; and, passing the feed stream from the first non-reactive zone to the first reaction zone.

In at least one embodiment, the process also includes injecting the catalyst into a reduction zone of the reactor and passing the catalyst from the reduction zone of the reactor to the first reaction zone. The reduction zone may be disposed above the first non-reactive zone of the reactor.

In some embodiments, the process also includes isolating the catalyst and the feed stream in the first non-reactive zone.

In one or more embodiments, the reactor includes a plurality of reaction zones arranged in series. It is contemplated that the reactor also includes a plurality of non-reactive zones, each non-reactive zone from the plurality of non-reactive zones disposed between consecutive reaction zones and each non-reactive zone including a first portion and a second portion, the first portion and the second portion separated by a baffle with at least one opening.

In at least one embodiment, a pressure in the first portion of the non-reactive zone is lower by about 1.24 kPad to about 68.9 kPad (about 0.18 to about 10 psi) than a pressure in the second portion of the non-reactive zone. It is contemplated that the process further includes maintaining the pressure in the second portion of the non-reactive zone to be in the range of about 1.24 kPad to about 68.9 kPad (about 0.18 to about 10 psi) greater than the pressure in the first portion of the non-reactive zone.

In various embodiments, the process also includes mixing the purge gas and the hydrocarbon feed stream in the first portion of the non-reactive zone to form a combined gas and passing the combined gas to the first reaction zone.

In various embodiments, the first reactive zone and the non-reactive zone may be separated by a plate having a plurality of apertures.

In at least one embodiment, a rate of flow purge gas from the second portion of the non-reactive zone to the first portion of the non-reactive zone is between about 0.06 to about 3 m/s (0.2 to 10 ft/s).

In a second aspect of the invention, the present invention may be broadly characterized as providing a reforming reactor with: at least one non-reactive zone having a first portion and a second portion separated by at least one baffle, the first portion of the at least one non-reactive zone including an inlet for a hydrocarbon feed stream, the second portion of the at least one non-reactive zone including an inlet for a purge gas; at least one reaction zone separated from the at least one non-reactive zone by a plate; and, at least one catalyst conduit for transporting catalyst through the non-reactive zone, an outlet for the at least one catalyst conduit being disposed in the at least one reaction zone.

In at least one embodiment, wherein the baffle includes at least one aperture.

In various embodiments, the baffle comprises a horizontal planar plate. It is contemplated that a distance between the inlet for the hydrocarbon feed stream and the horizontal planar plate is between about 2.5 to 61 cm (1 to 24 inches).

In some embodiments, the baffle comprises a planar horizontal portion and a vertical wall portion. It is contemplated that a distance between the inlet for the hydrocarbon feed stream and the planar horizontal portion of the baffle is between about 2.5 to 30.5 cm (1 to 12 inches) and the distance between the vertical wall portion of the baffle and a wall of the reactor is between about 15.2 to 61 cm (6 to 24 inches).

In various embodiments, the reforming reactor further comprises a reduction zone, wherein the non-reactive zone is disposed between the reduction zone and the at least one reaction zone.

In one or more embodiments, the reforming reactor further comprises at least one feed conduit to pass the hydrocarbon feed stream from the at least one non-reactive zone to the at least one reaction zone.

In at least one embodiment, the reforming reactor further comprises at least one aperture in the plate separating the at least one reaction zone from the at least one non-reactive zone.

In various embodiments, the reforming reactor further comprises a plurality of reaction zones and a plurality of non-reactive zones. Each non-reactive zone from the plurality of non-reactive zones disposed between consecutive reaction zones, and each non-reactive zone including a first portion and a second portion. The first portion and the second portion separated by a baffle with at least one opening.

In some embodiments, the reforming reactor includes a line configured to pass at least a portion of an effluent from a reaction zone to the purge gas inlet of a downstream non reaction zone.

Additional aspects, embodiments, and details of the invention are set forth in the following detailed description of the invention.

BRIEF DESCRIPTION OF THE DRAWINGS

In the drawings of the present invention, one or more embodiments are shown in which like numerals denote like elements and in which.

DETAILED DESCRIPTION OF THE INVENTION

Figure 1:
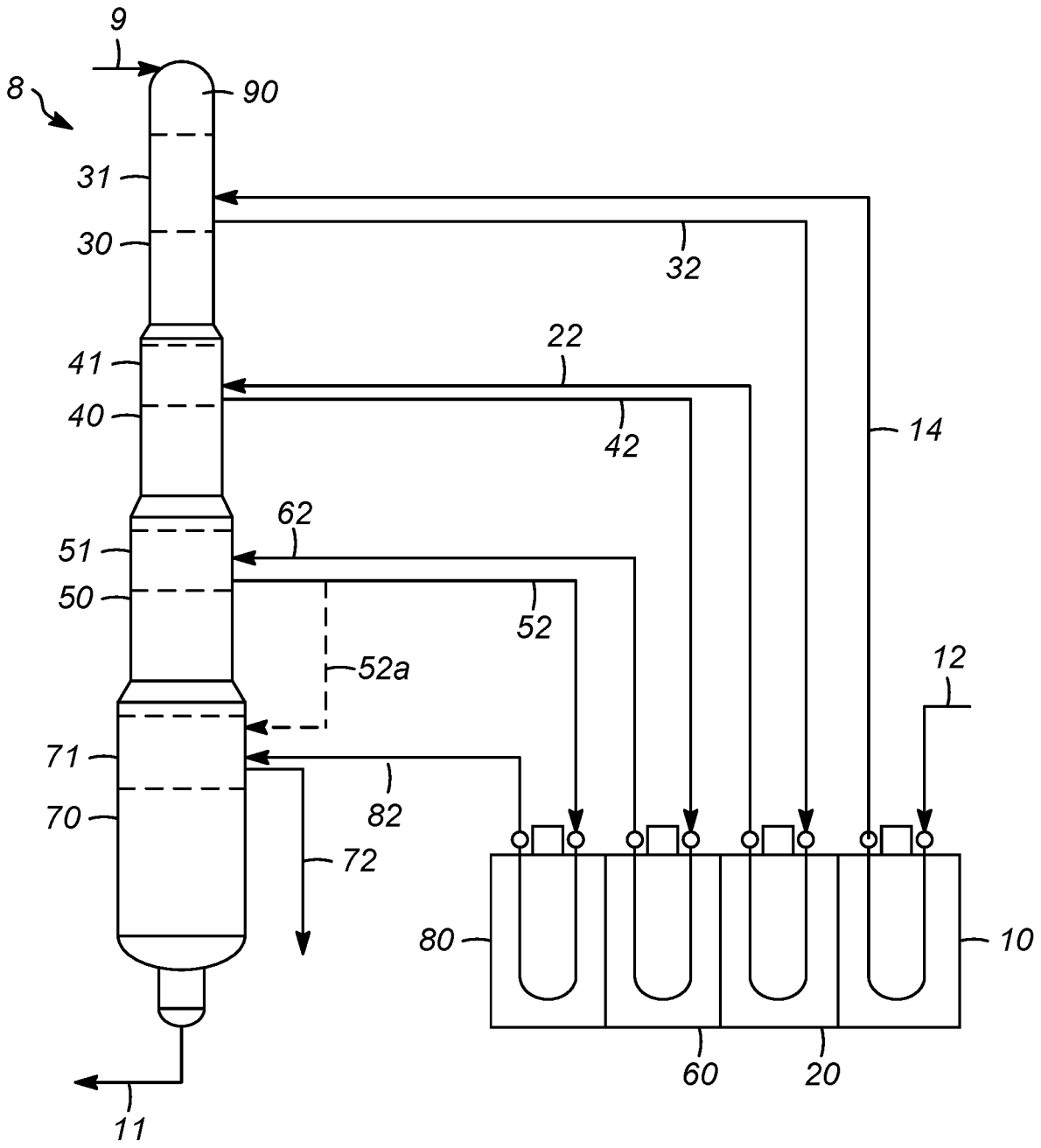
FIG. 1 shows a reactor unit according to one or more embodiments of the present invention.

As mentioned above, a reactor and process utilizing same have been invented in which the non-reactive space preceding a reactive zone in a reforming reactor is still present, but the amount accessible to the feedstock/effluent injected therein is minimized and the flow there though controlled with one or more baffles. The baffles allow the feedstock/partially converted effluent streams to be injected within the non-reactive spaces, while minimizing the space accessible to the feedstock/partially converted effluent streams. By minimizing the space, it is believed that the light ends conversion will be lower, thereby increasing the $C_5$+ hydrocarbon yield.

With these principles in mind, one or more embodiments of the present invention will now be described with the understanding that these embodiments are not intended to be limiting.

As mentioned above, with reference to FIG. 1, the present invention is directed to a reforming reactor 8 for a hydrocarbon feed stream 12. The hydrocarbon feed stream 12 typically comprises naphthenes and paraffins boiling within the gasoline range. The preferred feed streams 12 includes straight-run naphthas, thermally or catalytically cracked naphthas, partially reformed naphthas, raffinates from aromatics extraction and the like. Usually such feed streams 12 have been hydrotreated to remove contaminants, especially sulfur and nitrogen. A gasoline-range feed streams 12 may be a full-range naphtha having an initial boiling point from about 40° to about 70° C. and an end boiling point within the range from about 160° to about 220° C., or may be a selected fraction thereof. The feed stream 12 may be heated in a charge heater 10 and passed to the reforming reactor 8 along with a catalyst in a catalyst transfer line 9.

Operating conditions used for reforming processes usually include an absolute pressure selected within the range from about 100 to about 7,000 kPa (about 14.5 to about 1015 psi), or from about 350 to about 4,250 kPa (about 51 to about 616 psi). It is believed that particularly good results may be obtained at low pressure, namely an absolute pressure from about 350 to about 2,500 kPa (about 51 to about 363 psi). Reforming conditions include a temperature in the range from about 315° to about 600° C. (about 599° to about 1112° F.), or from about 425° to about 565° C. (about 797° to about 1049° F.). As is well known to those skilled in the reforming art, the initial selection of the temperature within this broad range is made primarily as a function of the desired octane of the product reformate, considering the characteristics of the feed stream and of the catalyst.

The reforming conditions in the present invention also typically include sufficient hydrogen to provide an amount from about 1 to about 20 moles of hydrogen per mole of hydrocarbon feed entering the reforming zone, with enhanced results being obtained when about 2 to about 10 moles of hydrogen are used per mole of hydrocarbon feed likewise, the liquid hourly space velocity (LHSV) used in reforming is selected from the range from about 0.1 to about 10 $hr^{-1}$, or from about 1 to about 5 $hr^{-1}$.

A multi-functional catalyst composite, which contains a metallic hydrogenation-dehydrogenation component on a porous inorganic oxide support providing acid sites for cracking and isomerization, is usually employed in catalytic reforming. Most reforming catalyst is in the form of spheres or cylinders having an average particle diameter or average cross-sectional diameter from about 1.59 to about 4.76 mm (1/16 inch to about 3/16 inch). Catalyst composites comprising platinum on highly purified alumina or on zeolitic supports are particularly well known in the art. Metallic modifiers that improve product yields or catalyst life, such as rhenium, iridium, tin, and germanium, also may be incorporated into the catalyst.

As shown in FIG. 1, the reforming reactor 8 contains a series of four reaction zones 30, 40, 50, 70 arranged vertically in reforming reactor 8. This is merely one configuration and is not intended to be limiting, other configurations may be utilized for practicing the present invention. Catalyst particles enter the top of the reforming reactor 8 through the catalyst transfer line 9 and pass through the series reaction zones 30, 40, 50, 70 under gravity flow. After passing through all of the reaction zones 30, 40, 50, 70, the catalyst particles are withdrawn from the bottom of the reforming reactor 8 by one or more catalyst withdrawal lines 11. Catalyst withdrawn through the catalyst withdrawal lines 11 may be regenerated by the oxidation and removal of coke deposits in a regeneration zone (not shown). After regeneration, catalyst particles may be again returned to the process and the reforming reactor 8 by the catalyst transfer line 9.

After the feed stream 12 is heated in charge heater 10, the heated feed 14 can pass to the first reaction zone 30. A first reactor effluent 32 is passed to a first heater 20 to generate a heated second reactor feed 22. A second reactor effluent 42 is passed to another heater 60 to generate a heated third reactor feed 62. A third reactor effluent 52 is passed to another heater 80 to generate a fourth reactor feed 82. A fourth reactor effluent 72 comprises a reformate product which can be recovered from the reactor 8 and processed further as is known. In the fixed bed and continuous catalyst regeneration reforming processes, the heaters are commonly used to heat up the feed streams 14, 22, 62, 82 to an elevated temperature and catalyzed by metal based catalyst in the catalyst reactive zone in order to meet the product quality specifications such as product octane, aromatics product yield, and hydrogen product yield.

As shown in the FIG. 1, the introduction of heated feed streams 14, 22, 62, 82 and withdrawal of effluent streams 32, 42, 52, 72 occurs in non-reactive zones 31, 41, 51, 71. As can be seen, some of the non-reactive zones 31, 41, 51, 71 are spaced between consecutive reaction zone 30, 40, 50, 70, while the first non-reactive zone 31 is disposed between the first reaction zone 30 and a catalyst introduction zone 90. The catalyst introduction zone 90 may comprise a reduction zone. In a reduction zone, the oxidized catalyst from the catalyst regeneration section (not shown) is reduced to a reduced state for optimal performance. Alternatively, the catalyst introduction zone 90 may comprise a catalyst surge zone which provides catalyst surging capability.

The non-reactive zones 31, 41, 51, 71 typical comprise a distribution zone which tends to be thermally unstable in which catalyst is substantially absent. As mentioned above, in these non-reactive zones 31, 41, 51, 71 components of the heavy hydrocarbon species, principally $C_6$+ (six carbon molecules and heavier) in the feed streams 14, 22, 62, 82, may non-catalyzed undergo molecular weight reduction transformation in a manner in which the molecules break down to two or more smaller molecules with lower molecular weight. This non-catalyzed molecular weight reduction transformation occurs in absence of catalyst when these heavy hydrocarbon species spend sufficient resident time in the non-reactive zones 31, 41, 51, 71 zone at highly elevated temperature environment typically about 482° C. (900° F.) or above. Additionally, typically molecules involved in the molecular weight reduction transformation consume hydrogen.

Typical fixed bed reforming process or continuous regeneration process have an operating temperature near or above 480° C. (950° F.). This phenomenon of non-catalyzed molecular weight reduction transformation is well understood in fixed bed reforming process and continuous catalyst regeneration processes. The non-catalyzed transformation of molecule weight reduction prior to entering the reaction zone 30, 40, 50, 70 results in lower $C_5$+ hydrocarbon yield, lower product aromatics yield, and lower hydrogen yield. The severity and amount of hydrocarbons undergoing this undesired non-catalyzed molecular weight reduction transformation depend on numbers of factors including operating temperature, boiling point temperature of the hydrocarbon species, types of the hydrocarbon species, and duration of resident time the hydrocarbons spending at the elevated temperature environment prior to entering the reaction zone 30, 40, 50, 70.

The size or volume of the non-reactive zones 31, 41, 51, 71 is typically governed by personnel access requirement for performing maintenance activities and installation of the reactor internals. Additionally, as discussed below, the size of the non-reactive zones 31, 41, 51, 71 is also governed by system hydraulics requirement for proper catalyst flow transportation between an upper catalyst containing vessel such as catalyst introduction zone 90, or a reaction zone 30, 40, 50, and another reaction zone 30, 40, 50, 70. These requirements generally govern the dimensional size for the non-reactive zones 31, 41, 51, 71 and the size is often greater than the required size or volume for proper feed distribution to achieve even flow. Typically, the volume of the non-reactive zones 31, 41, 51, 71 determines the resident time of the heated feed streams 14, 22, 62, 82 in the non-reactive zones 31, 41, 51, 71.

The present invention is directed at reducing the unwanted volume in the non-reactive zones 31, 41, 51, 71, and thereby reducing the residence time of the feed streams 14, 22, 62, 82 within the non-reactive zones 31, 41, 51, 71. By reducing the residence time, the amount of heavy hydrocarbons in the feed streams 14, 22, 62, 82 undergoing the non-catalyzed molecular weight reduction transformation in the non-reactive zones 31, 41, 51, 71 is reduced. By reducing the non-catalyzed molecular weight reduction transformation, the yield of desired hydrocarbons from the reactor may be increased. As will be discussed, the reduction of residence time can be achieved without reducing the volume of the non-reactive zones 31, 41, 51, 71.

Figure 2:
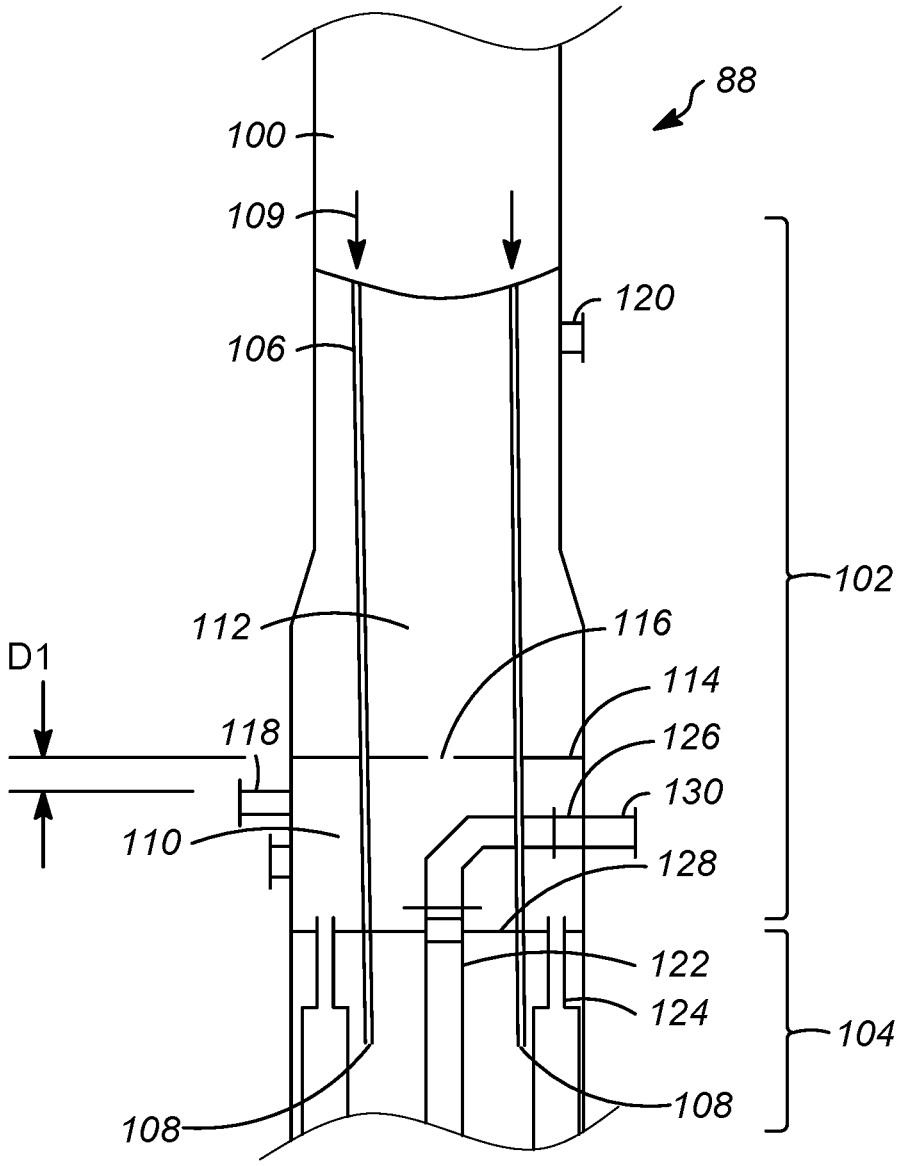
FIG. 2 shows a side cutaway view of a portion of a reactor unit according to one or more embodiments of the present invention.

For example, as shown in FIG. 2, a reactor unit 88 is shown which includes a catalyst source zone 100, a non-reactive zone 102 and a reaction zone 104. The catalyst source zone 100 may comprise the catalyst introduction zone 90 (from FIG. 1) or a reaction zone 30, 40, 50 (from FIG. 1) depending on the number of reaction zones and the type of reactor unit 88. Conduits 106 transfer catalyst 109 from the catalyst source zone 100 through the non-reactive zone 102 so that the catalyst 109 is isolated from any reactants within the non-reactive zone 102. Outlets 108 for the conduits 106 are disposed within the reaction zone 104.

In this depicted embodiment, the non-reactive zone 102 is separated into two portions 110, 112. The first portion 110 of the non-reactive zone 102 preferably may comprises a thermally unstable zone. The second portion 112 of the non-reactive zone 102 may comprises a thermally stable zone. The first portion 110 of the non-reactive zone 102 is preferably physically and hydraulically separated from the second portion of the non-reactive zone 102. For example, a baffle 114 having at least one opening 116 may be utilized to separate the two portions 110, 112 of the non-reactive zone 102. The baffle 114 is preferably located as close as possible to a feed inlet nozzle 118 for a feed (which may be one of the heated feed streams 14, 22, 62, 82 from FIG. 1). A distance (D1) between the feed inlet nozzle 118 and the baffle 114 is preferably between about 2.5 to about 61 cm (less than 1 inch to 24 inches). The baffle 114 may be a solid plate which may be orientated in a horizontal planar configuration and with an outer shape the same as a horizontal cross section of the reactor unit 88 (for example, a circle).

The second portion 112 of the non-reactive zone 102 includes an inlet 120 for a purge gas. The purge gas comprises molecular weight stable gas at the operating temperature of the reactor unit 88 and can be, for example, inert gas such halide, nitrogen, or hydrogen rich gas containing more than 70% by volume of hydrogen, light hydrocarbon species ($C_5$-hydrocarbons) and less than 5% by volume of $C_6$ hydrocarbons, preferably containing 80% or more by volume of hydrogen and less than 1% by volume of $C_6$ hydrocarbons.

As shown in FIG. 1, it is contemplated that the purge gas for the non-reactive zone may comprise a portion of the effluent 32, 42, 52, 72 from a reaction zone 30, 40, 50, 70, preferably an upstream reaction zone. For example, with reference to FIG. 1, a portion of the effluent 52 form the third reaction zone 50 in line 52*a* may be used as the purge gas in the non-reactive zone 71 associated with the fourth reaction zone 70. Use of a portion of the effluent 32, 42, 52, 72 will minimize the need or use of an external purge gas, which may be especially beneficial in applications in which the invention is practiced by revamping an existing reformer.

To prevent the feed from diffusing to and occupying the second portion 112 of the non-reactive zone 102, the second portion 112 of the non-reactive zone 102 is preferably kept at a higher pressure than the first portion 110 of the non-reactive zone 102 by a differential pressure controller and control valve (not shown). The differential pressure control valve injects sufficient amounts of purge gas rate on a continuous basis to maintain a positive differential pressure between the first portion 110 and the second portion 112 that is preferably between 1.24 kPad to 68.9 kPad (about 0.18 to about 10 psi).

It is preferred that the baffle 114 comprises a plurality of openings 116 allowing the purge gas to sweep (or pass) through the second portion 112 of the non-reactive zone 102 with a gas velocity of about 0.06 m/s to about 3 m/s (0.2 to 10 ft/s). This will help prevent the feed from migrating to the second portion 112 of the non-reactive zone 102. This velocity will also help prevent the baffle 114 from overpressuring by the purge gas.

In operation, the feed flows in an inward direction towards a reactor centerpipe 122. The purge gas will pass through the opening(s) 116 in the baffle 114, and mix with the feed inside the first portion 110 of the non-reactive zone 102. The combined gas may pass to the reaction zone 104 through conduits 124, such as scallops. See, e.g., U.S. Pat. Nos. 5,366,704, 6,224,838, and 7,842,257. The conduits 124 typically include a perforate plate or screen and distribute the feed passing to the reaction zone 104. Preferably, there is a positive pressure differential between the first portion of the non-reactive zone 110 and the conduits 124 that is between about 0.2 to about 24 kPad (about 0.03 to about 3.5 psi). This pressure differential will allow the first portion 110 of the non-reactive zone to function as a distribution chamber for the feed entering through the inlet 118. In those cases in which the purge gas comprises a portion of an effluent from a reforming reactor, the effluent-purge gas will thus pass to the reactive zone 102, along with the feed stream.

In some reactor units 88, the reactor effluent flows upward inside the reactor centerpipe 122. The reactor effluent will pass through the reactor effluent elbow 126 locating above a plate 128 separating the reaction zone 104 and the non-reactive zone 102 and exit the reactor unit 88 via an outlet 130. Although not depicted as such, in the reactor centerpipe 122, the effluent may flows downward inside a downflow reactor centerpipe, and pass through a reactor effluent elbow locating below the reaction zone and exit the reactor unit 88. There may be small gaps or openings in the plate 128 which may allow some of the combined gas to pass to the reaction zone 104 without passing through the conduits 124. This bypass flow rate is between 2 to 10% of the total mixed gas by volume, preferably between 3 to 7%.

Figure 3:
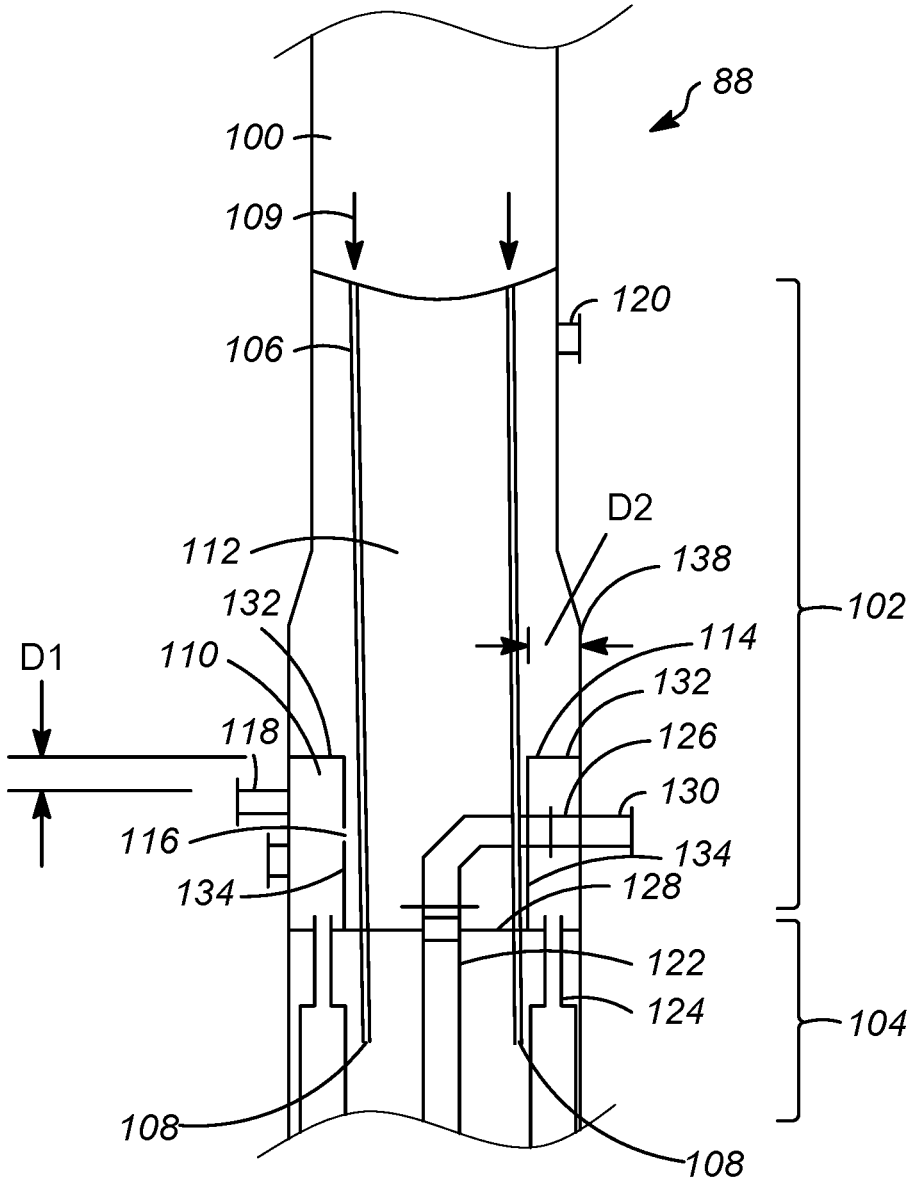
FIG. 3 shows another side cutaway view of a portion of another reactor unit according to one or more embodiments of the present invention; and, FIG. 4 shows another side cutaway view of a portion of another reactor unit according to one or more embodiments of the present invention.

In FIG. 3, the baffle 114 separating the first portion 110 and the second portion 112 of non-reactive zone 102 includes a horizontal portion 132 and a vertical portion 134.

The horizontal portion 132 of the baffle 114 is preferably located as close as possible to the reactor feed inlet nozzle 118, preferably with a distance D1 between 61 to 2.5 cm (24 inches to less than 1 inch). The distance from a wall 138 of the non-reactive zone 102 and the vertical portion 134 may range from 15.2 to 61 cm (6 to 24 inches), preferably 20.3 to 35.6 cm (8 to 14 inches). It is desirable that the distance D2 from a wall 138 of the non-reactive zone 102 to the vertical portion 134 is as small as possible to minimize the volume of the first portion 110; however the distance D2 should be wide enough to serve as a flow distribution chamber or device to sufficiently distribute the fluid to all conduits 124 evenly, so that each of the conduits 124 receives an even amount of feed. However, this distance D2 should also not be so restrictive to the combined gas flow resulting in excessive pressure drop between the feed inlet nozzle 118 and the reaction zone 104. The multi-portion baffle 114 creates a distribution chamber resulting in pressure differential between the first portion 110 of the non-reactive zone 102 and the conduits 124 of reaction zone 104 between about 0.2 and about 24 kPad (about 0.03 to about 3.5 psi). The baffle 114 preferably extends to the plate 128 to form a seal in order to contain the feed within the first portion 110 of the non-reactive zone 102. Again, the multi-portion baffle 114 comprises one or more openings 116 to allow the purge gas to mix with the feed within the first portion 110 of the non-reactive zone 102 in order to prevent the feed from entering the second portion 112 of the non-reactive zone 102. The remaining elements of this embodiment are similar to those discussed above with respect to FIG. 2.

Figure 4:
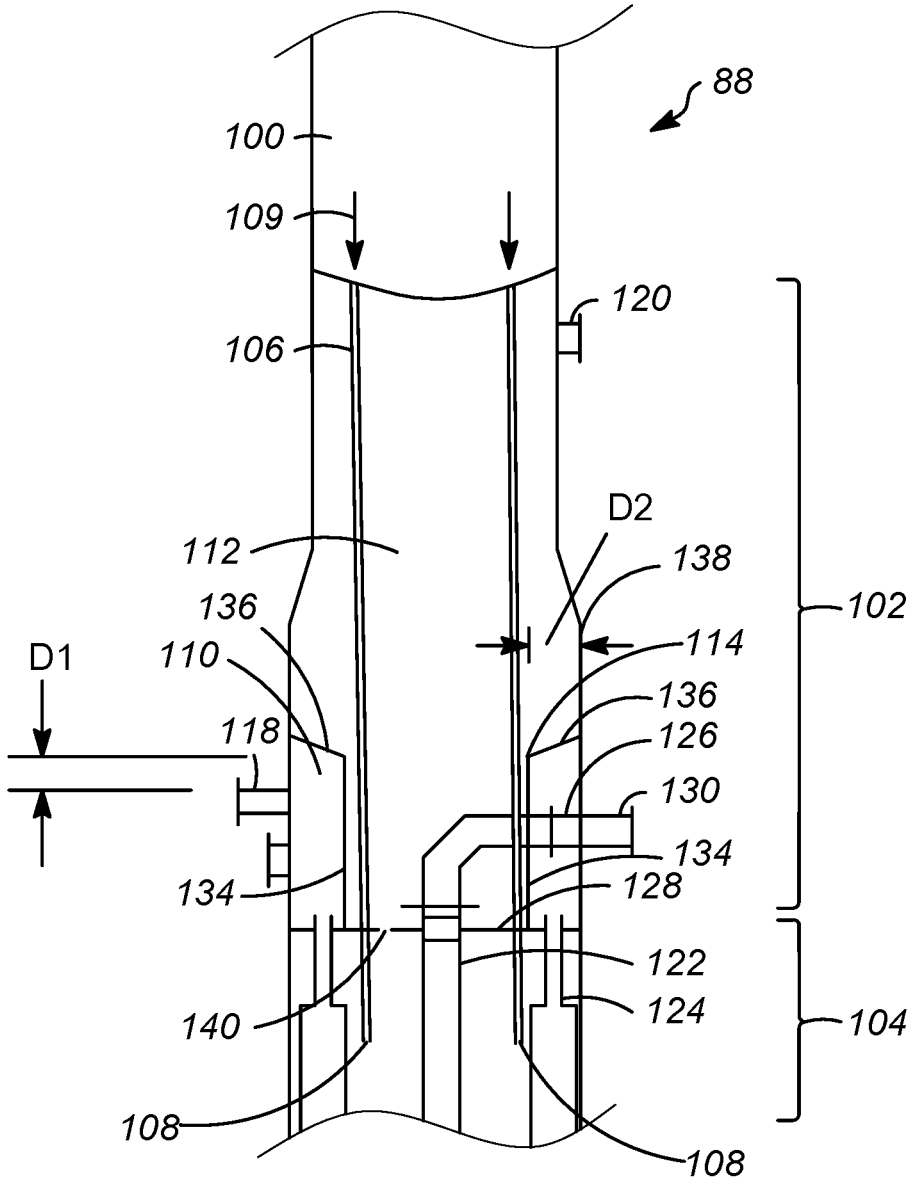

As shown in FIG. 4, the baffle 114 separating the first portion 110 and the second portion 112 of non-reactive zone 102 includes a vertical portion 134 and a top portion 136. The top portion 136 of the baffle 114 is angled (or sloped) towards the center of the reactor 88. Other configurations may be used. Furthermore, unlike the depiction of FIGS. 2 and 3, as shown in FIG. 4, the baffle 114 does not include any openings. Therefore, the feed will be injected into the first portion 110 of the non-reactive zone 102 and pass through the conduits 124 into the reaction zone 104. The purge gas is injected into the second portion 112 of the non-reactive zone 102, for example via the inlet 120. The purge gas will then flow into the reaction zone 104 of the reactor 88. In order to allow the purge gas to flow into the reaction zone 104, the plate 128 separating the reaction zone 104 and the non-reactive zone 102 may include one or more openings 140.

Although not depicted as such, it is contemplated that a baffle used to practice the present invention may include any of the following portions, alone or in combination: horizontal portions, vertical portions, and sloped portions including only horizontal, vertical, and sloped portions.

In any configuration, by creating a smaller space for the feed to occupy within the non-reactive zone, the residence time within the non-reactive zone can be shortened. It is believed that by shortening this residence time, the amount of the molecular weight reduction can be reduced, and the yields for the $C_5$+ hydrocarbons increased.

It should be appreciated and understood by those of ordinary skill in the art that various other components such as valves, pumps, filters, coolers, etc. were not shown in the drawings as it is believed that the specifics of same are well within the knowledge of those of ordinary skill in the art and a description of same is not necessary for practicing or understating the embodiments of the present invention.

SPECIFIC EMBODIMENTS

While the following is described in conjunction with specific embodiments, it will be understood that this description is intended to illustrate and not limit the scope of the preceding description and the appended claims.

A first embodiment of the invention is a process for increasing a C5+ hydrocarbon yield in a reforming reactor unit, the processing comprising passing a catalyst though a first non-reactive zone of a reactor to a first reaction zone of the reactor, the first non-reactive zone comprising a first portion and a second portion, the first portion and the second portion separated by a baffle; injecting a hydrocarbon feed stream into the first portion of the first non-reactive zone of the reactor; injecting a purge gas into the second portion of the first non-reactive zone of the reactor; passing the purge gas to the first reaction zone; and, passing the feed stream from the first portion of the first non-reactive zone to the first reaction zone. An embodiment of the invention is one, any or all of prior embodiments in this paragraph up through the first embodiment in this paragraph wherein the baffle includes at least one aperture configured to allow the purge gas to pass from the second portion of the first non-reactive zone to the first portion of the non-reactive zone. An embodiment of the invention is one, any or all of prior embodiments in this paragraph up through the first embodiment in this paragraph wherein the reactor includes a plurality of reaction zones arranged in series. An embodiment of the invention is one, any or all of prior embodiments in this paragraph up through the first embodiment in this paragraph, wherein the reactor includes a plurality of non-reactive zones, each non-reactive zone from the plurality of non-reactive zones being disposed between consecutive reaction zones and each non-reactive zone including a first portion and a second portion, the first portion and the second portion being separated by a baffle. An embodiment of the invention is one, any or all of prior embodiments in this paragraph up through the first embodiment in this paragraph wherein a purge gas for at least one non-reactive zone comprises at least a portion of an effluent from an upstream reaction zones. An embodiment of the invention is one, any or all of prior embodiments in this paragraph up through the first embodiment in this paragraph wherein a pressure in the first portion of the first non-reactive zone is lower by about 1.24 kPad to about 68.9 kPad (about 0.18 to about 10 psi) than a pressure in the second portion of the first non-reactive zone. An embodiment of the invention is one, any or all of prior embodiments in this paragraph up through the first embodiment in this paragraph wherein the feed stream is passed from the first portion of the non-reactive zone via one or more feed conduits, and wherein a pressure in the first portion of the first non-reactive zone is higher by about 0.2 to about 24 kPad (about 0.03 to about 3.5 psi) than a pressure of the feed conduits. An embodiment of the invention is one, any or all of prior embodiments in this paragraph up through the first embodiment in this paragraph further comprising mixing the purge gas and the hydrocarbon feed stream in the first portion of the first non-reactive zone to form a combined gas and passing the combined gas to the first reaction zone. An embodiment of the invention is one, any or all of prior embodiments in this paragraph up through the first embodiment in this paragraph wherein the first reactive zone and the non-reactive zone are separated by a plate having a plurality of apertures. An embodiment of the invention is one, any or all of prior embodiments in this paragraph up through the first embodiment in this paragraph wherein a rate of flow purge gas from the second portion of the non-reactive zone to the first portion of the non-reactive zone is between about 0.06 to about 3 m/s (0.2 to 10 ft/s).

A second embodiment of the invention is a reforming reactor comprising at least one non-reactive zone having a first portion and a second portion separated by at least one baffle, the first portion of the at least one non-reactive zone including an inlet for a hydrocarbon feed stream and the second portion of the at least one non-reactive zone including an inlet for purge gas; at least one reaction zone separated from the at least one non-reactive zone by a plate; and, at least one catalyst conduit for transporting catalyst through the non-reactive zone, an outlet for the at least one catalyst conduit being disposed in the at least one reaction zone. An embodiment of the invention is one, any or all of prior embodiments in this paragraph up through the second embodiment in this paragraph further comprising the plate including at least one aperture. An embodiment of the invention is one, any or all of prior embodiments in this paragraph up through the second embodiment in this paragraph wherein the baffle comprises a horizontal planar plate having at least one aperture. An embodiment of the invention is one, any or all of prior embodiments in this paragraph up through the second embodiment in this paragraph wherein a distance between the inlet for the hydrocarbon feed stream and the horizontal planar plate is between about 2.5 to 30.5 cm (1 to 12 inches). An embodiment of the invention is one, any or all of prior embodiments in this paragraph up through the second embodiment in this paragraph wherein the baffle comprises a planar horizontal portion and a vertical wall portion. An embodiment of the invention is one, any or all of prior embodiments in this paragraph up through the second embodiment in this paragraph wherein a distance between the inlet for the hydrocarbon feed stream and the planar horizontal portion of the baffle is between about 2.5 to 30.5 cm (1 to 12 inches) and the distance between the vertical wall portion of the baffle and a wall of the reactor is between about 15.2 to 61 cm (6 to 24 inches). An embodiment of the invention is one, any or all of prior embodiments in this paragraph up through the second embodiment in this paragraph further comprising a reduction zone, wherein the at least one non-reactive zone is disposed between the reduction zone and the at least one reaction zone. An embodiment of the invention is one, any or all of prior embodiments in this paragraph up through the second embodiment in this paragraph further comprising at least one feed conduit to pass the hydrocarbon feed stream from the at least one non-reactive zone to the at least one reaction zone. An embodiment of the invention is one, any or all of prior embodiments in this paragraph up through the second embodiment in this paragraph further comprising a plurality of reaction zones; and, a plurality of non-reactive zones, each non-reactive zone from the plurality of non-reactive zones being disposed between consecutive reaction zones, and each non-reactive zone including a first portion and a second portion, the first portion and the second portion being separated by a baffle, and the first portion including an inlet for a hydrocarbon feed stream and the second portion including an inlet for a purge gas. An embodiment of the invention is one, any or all of prior embodiments in this paragraph up through the second embodiment in this paragraph further comprising a line for communicating at least a portion of an effluent of a reaction zone to the inlet for the purge gas of a downstream non-reactive zone.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

The invention claimed is:

1. A process for increasing a $C_5$+ hydrocarbon yield in a reforming reactor unit, the processing comprising:

passing a catalyst through a conduit in a non-reactive zone of a reactor to a reaction zone of the reactor, the non-reactive zone comprising a first portion and a second portion, the first portion and the second portion separated by a baffle;

injecting a hydrocarbon feed stream into the first portion of the non-reactive zone of the reactor;

injecting a purge gas into the second portion of the non-reactive zone of the reactor to generate a positive differential pressure between the first portion and the second portion of the non-reactive zone; and passing the feed stream from the first portion of the non-reactive zone to the reaction zone, wherein the catalyst in the conduit is isolated from the feed stream in the non-reactive zone.

2. The process of claim 1, wherein the baffle includes at least one aperture configured to allow the purge gas to pass from the second portion of the non-reactive zone to the first portion of the non-reactive zone.

3. The process of claim 1, wherein the reactor includes a plurality of reaction zones arranged in series.

4. The process of claim 3, wherein the reactor includes a plurality of non-reactive zones, each non-reactive zone from the plurality of non-reactive zones being disposed between consecutive reaction zones and each non-reactive zone including a first portion and a second portion, the first portion and the second portion being separated by a baffle.

5. The process of claim 4, wherein a purge gas for at least one non-reactive zone comprises at least a portion of an effluent from an upstream reaction zone.

6. The process of claim 1, wherein a pressure in the first portion of the non-reactive zone is lower by about 1.24 kPa to about 68.9 kPa (about 0.18 psi to about 10 psi) than a pressure in the second portion of the non-reactive zone.

7. The process of claim 1, wherein the feed stream is passed from the first portion of the non-reactive zone via one or more feed conduits, and wherein a pressure in the first portion of the non-reactive zone is higher by about 0.2 kPa to about 24 kPa (about 0.03 psi to about 3.5 psi) than a pressure of the feed conduits.

8. The process of claim 1, further comprising:

mixing the purge gas and the hydrocarbon feed stream in the first portion of the non-reactive zone to form a combined gas and passing the combined gas to the reaction zone.

9. The process of claim 1, wherein the reactive zone and the non-reactive zone are separated by a plate having a plurality of apertures.

10. The process of claim 2, wherein a rate of flow purge gas from the second portion of the non-reactive zone to the first portion of the non-reactive zone is between about 0.06 m/s to about 3 m/s (0.2 ft/s to 10 ft/s).

* * * * *